US006056462A

United States Patent [19]

Fukai et al.

[11] Patent Number: 6,056,462

[45] Date of Patent: May 2, 2000

[54] WRITING INSTRUMENT WITH GRIP RUBBER

[75] Inventors: Akira Fukai, Yokohama; Norio Osawa, Soka; Hideki Takizawa, Yokohama, all of Japan

[73] Assignee: Mitsubishi Pencil Kabushiki Kaisha, Tokyo, Japan

[21] Appl. No.: 09/229,707

[22] Filed: Jan. 13, 1999

[30] Foreign Application Priority Data

Jan. 28, 1998 [JP] Japan ..... 10-030432
Jan. 28, 1998 [JP] Japan ..... 10-030434

[51] Int. Cl.[7] ..... A46B 5/02
[52] U.S. Cl. ..... 401/6
[58] Field of Search ..... 401/6, 202, 243, 401/244, 246, 54, 61, 7, 99

[56] References Cited

U.S. PATENT DOCUMENTS 2,173,451 5/1939 Lorder ..... 401/6
5,794,767 8/1998 Wilson ..... 206/37
5,971,644 10/1999 Kageyama et al. ..... 401/99

FOREIGN PATENT DOCUMENTS 3406522 9/1995 Germany ..... 401/6
669165 12/1949 United Kingdom ..... 401/192

*Primary Examiner*—Henry J. Recla
*Assistant Examiner*—Huyen Le
*Attorney, Agent, or Firm*—Darby & Darby

[57] ABSTRACT

A writing instrument with a grip rubber, in which a hole is provided in the grip rubber layer formed in outer periphery of a barrel cylinder body, and a protrusion for catching a cap provided in the barrel cylinder body is protruded from the hole to outside of the grip rubber layer, and/or a hole of the same shape as a decorative pattern is provided in the above-mentioned grip rubber layer, thereby outer face of the barrel cylinder body having a different color from that of the grip rubber is exposed from the hole.

6 Claims, 8 Drawing Sheets

WRITING INSTRUMENT WITH GRIP RUBBER

BACKGROUND OF THE INVENTION (1) Field of the Invention

The present invention relates to a writing instrument having a grip rubber coating layer, more particularly, relates to a writing instrument having a decorated grip rubber.

(2) Description of the Prior Art

Since a conventional writing instrument is arranged with a grip rubber 9 at the rear of a protrusion 10 for catching a cap, as shown in FIG. 1, the distance from the writing tip 11 of the pen to the grip rubber 9 is long, and when it is gripped by fingers, the fingertip does not touch the grip rubber 9, instead, a front portion off the grip rubber 9 is gripped, thus the grip rubber 9 becomes useless.

Various writing instruments are known, in which a grip rubber of a soft material is attached to a portion gripped by fingers in the barrel cylinder. When a cap is fitted to such a writing instrument with a grip rubber, a protrusion 10 for catching the cap has been conventionally arranged in the front portion off the grip rubber 9 attached to the barrel cylinder body 8.

Furthermore, when the grip rubber is decorated, means such as printing, imprinting or the like has been conventionally adopted. Printing, however, has a disadvantage that it leads to a cost increase, and imprinting has a disadvantage that the decorative pattern is inconspicuous, and has little appeal to consumers.

SUMMARY OF THE INVENTION

It is, therefore, an object of the present invention to provide a cap-type writing instrument with a grip rubber, in which the distance from the writing tip of the pen to the grip rubber can be reduced so that the fingertip touches the grip rubber reliably, and the protrusion for catching the cap can be disposed in the barrel cylinder body conveniently. Moreover, it is another object of the present invention to provide a freshly decorated barrel for writing instrument, in which decorative pattern can be arranged conspicuously in a position where the grip rubber is attached, at a low cost, and which can increase appeal to consumers.

The present invention has been completed to solve the above-mentioned problems, and the gist thereof is as described below.

First, the first gist of the present invention is a writing instrument with a grip rubber, in which a hole is provided in the grip rubber layer formed in outer periphery of a barrel cylinder body, and a protrusion for catching a cap provided in the barrel cylinder body is protruded from the hole to outside of the grip rubber layer.

The second gist of the present invention is a writing instrument with a grip rubber, in which a hole of the same shape as a decorative pattern is provided in the grip rubber layer formed in outer periphery of a barrel body, thereby outer face of the barrel body having a different color from that of the grip rubber is exposed from the hole.

The third gist of the present invention is a writing instrument with a grip rubber, in which a hole of the same shape as a decorative pattern is provided in the grip rubber layer formed in outer periphery of the barrel body, thereby outer face of the barrel body having a different color from that of the grip rubber is exposed from the hole, as well as a protrusion to be fitted into the hole is provided in a position corresponding to the hole for decoration in the grip rubber layer, such that surface of the protrusion becomes lower than surface of the grip rubber by 0.2 to 0.5 mm.

The fourth gist of the present invention is a writing instrument with a grip rubber, in which a hole is provided in the grip rubber layer formed in outer periphery of a barrel cylinder body, and a protrusion for catching a cap provided in the barrel cylinder body is protruded from the hole to outside of the grip rubber layer, and further, a hole of the same shape as a decorative pattern is provided in the grip rubber layer formed in the outer periphery of the barrel body, thereby outer face of the barrel body having a different color from that of the grip rubber is exposed from the hole.

The fifth gist of the present invention is a writing instrument with a grip rubber, in which a hole is provided in the grip rubber layer formed in outer periphery of the barrel cylinder body, a protrusion for catching a cap provided in the barrel cylinder body is protruded from the hole to outside of the grip rubber layer, and a hole of the same shape as a decorative pattern is provided in the grip rubber layer formed in the outer periphery of the barrel body, thereby outer face of the barrel body having a different color from that of the grip rubber is exposed from the hole, as well as a protrusion to be fitted into the hole is provided in a position corresponding to the hole for decoration in the grip rubber layer, such that surface of the protrusion becomes lower than surface of the grip rubber by 0.2 to 0.5 mm.

Furthermore, the sixth gist of the present invention is a writing instrument with a grip rubber according to the gist 1 to 5, wherein the grip rubber layer is formed by being fitted into the barrel cylinder body.

Furthermore, the seventh gist of the present invention is a writing instrument with a grip rubber according to the gist 1 to 5, wherein the grip rubber layer is formed integrally with the barrel cylinder body by a bi-color molding.

The present invention is constituted as described above. Therefore, since a hole is provided in the grip rubber layer, and a protrusion for catching a cap provided in the barrel cylinder body is protruded from the hole to outside of the grip rubber layer, the position to provide the protrusion is within a range of the grip rubber, thus there is no need to provide the protrusion in front portion off the grip rubber. Accordingly, by moving the grip rubber forward by that amount, the distance from the writing tip of the pen to the grip rubber can be reduced, and when the pen is gripped with fingers, fingers can reliably touch the grip rubber.

Furthermore, in the present invention, since a decorative pattern appears in the color of the outer face of the barrel body of a different color from that of the grip rubber, the decorative pattern becomes conspicuous and makes an appeal to consumers. Moreover, since a hole can be easily provided in the grip rubber, the production cost becomes lower than the printing cost.

Here, the "decorative pattern" is meant to include characters as well.

DESCRIPTION OF THE PREFERRED EMBODIMENTS

First Embodiment

Figure 3:
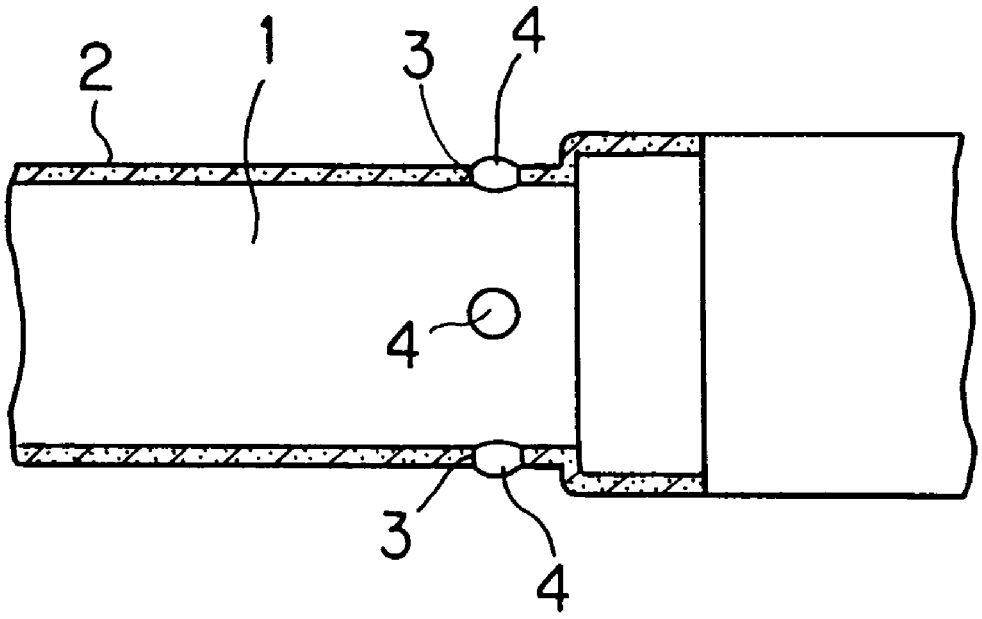
FIG. 3 is a sectional view along the line 12–13 in FIG. 2.
Figure 4:
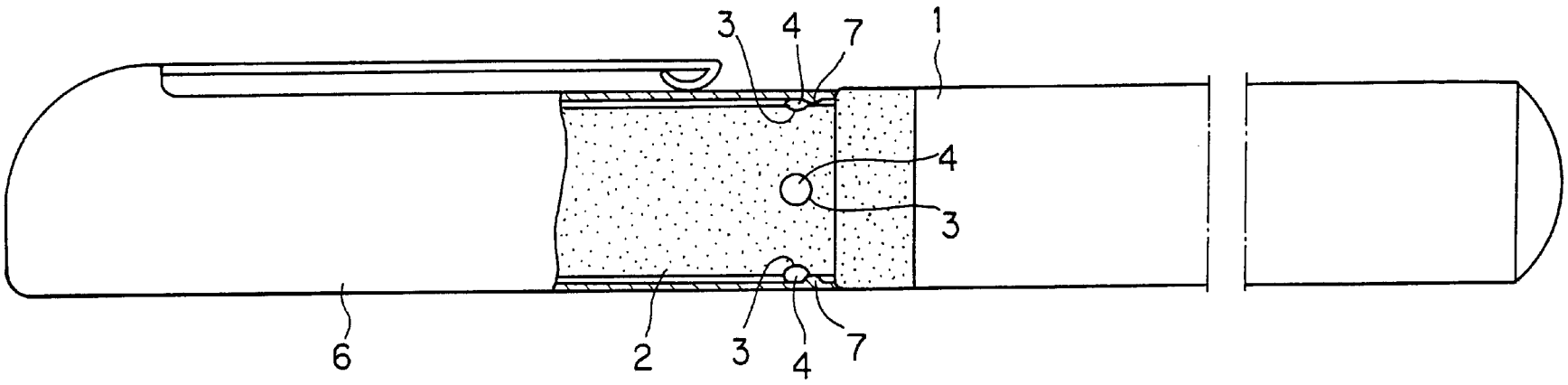
FIG. 4 is a partly cutaway side view in a state that a cap is put on, in the first embodiment of the present invention.

The first embodiment of the present invention shown in FIG. 2 to FIG. 4 will now be described.

Figure 1:
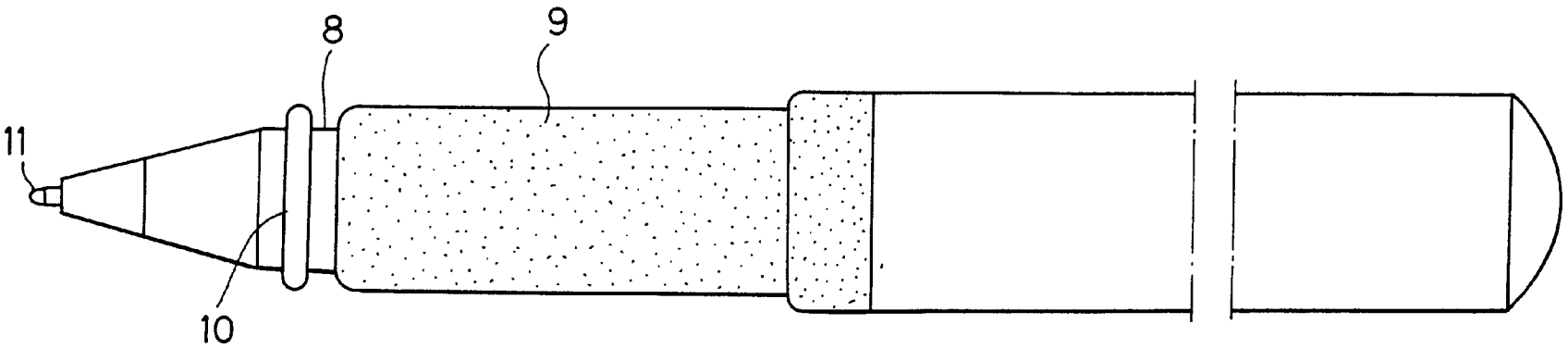
FIG. 1 Prior Art
FIG. 1 is a side view showing a conventional example, in a state that a cap is removed.
Figure 2:
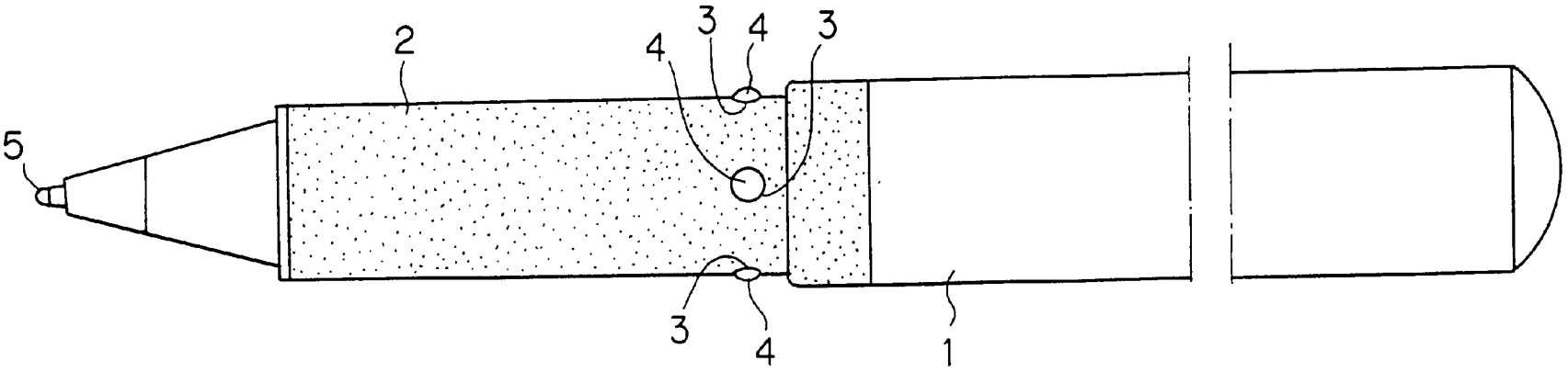
FIG. 2 is a side view in a state that a cap is removed, in the first embodiment of the present invention.

First, as shown in FIG. 2, a grip rubber layer 2 having elasticity is formed at the front end close to the writing tip 5 of the pen, where fingers touch when the pen is gripped with fingers at the barrel cylinder. The grip rubber 2 covers the barrel cylinder body 1 made of plastic, and is provided with holes 3 in four places, in the vicinity of the rear end in the peripheral direction, as shown in FIG. 3. Moreover, in the barrel cylinder body 1 inside of the grip rubber 2, protrusions 4 are provided at a position corresponding to the holes in the grip rubber 2, and protrusion 4 protrude from the holes 3 to outside of the grip rubber 2 by at least 0.2 mm. The protrusion 4 serves to fix a cap 6 by engaging with a projecting stripe 7 provided in the peripheral direction in a protruding condition on the inner face of the cap 6.

In the first embodiment of the present invention, since the protrusion for catching the cap provided in the barrel cylinder body is protruded from the hole to outside of the grip rubber, the protrusion for catching the cap can be positioned within a range of the grip rubber, and there is no need to dispose the grip rubber in the rear portion off the protrusion, hence the grip rubber can be disposed closer to the writing tip of the pen by that amount, and when being gripped by fingers, fingers can touch the grip rubber reliably.

Moreover, there is another advantage that since there is no need to dispose the grip rubber in the rear portion off the protrusion, restriction on design is reduced.

Furthermore, there is another advantage that since the protrusion of the barrel cylinder body fits into the hole of the grip rubber, an effect of preventing the rotation of the grip rubber can be expected.

Second Embodiment

The second embodiment of the present invention will now be described with reference to the drawings.

Figure 5:
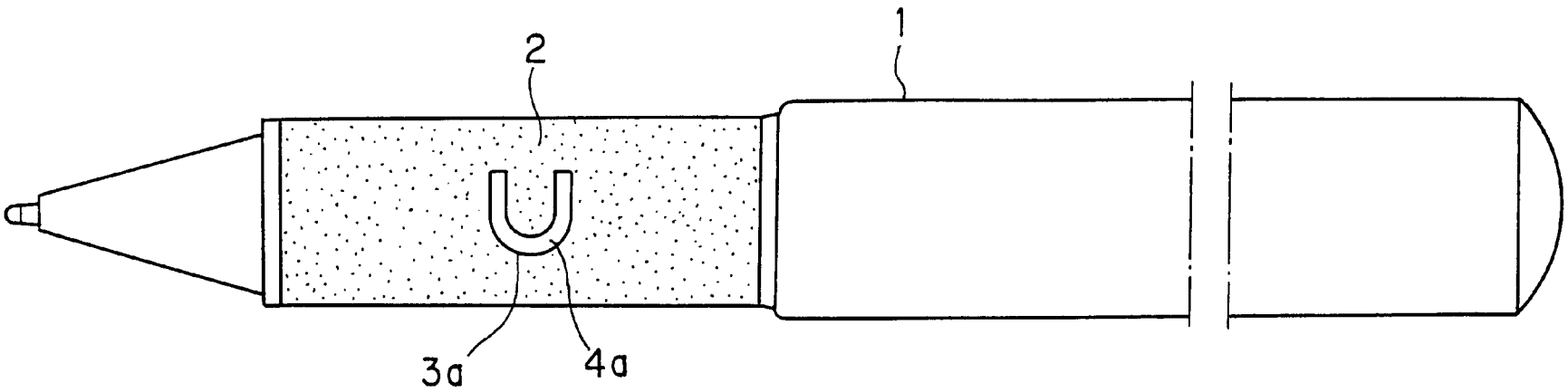
FIG. 5 is a side view in the second embodiment of the present invention.

First, as shown in FIG. 5, a grip rubber 2 is formed in the outer periphery of the barrel body 1, roughly in the front half of the barrel of the writing instrument. The color of the grip rubber 2 is different from that of the barrel body 1. The grip rubber 2 is provided with a hole 3 having the same shape with that of the decorative pattern (a character In the case of this embodiment). Therefore, the outer face of the barrel body 1 is exposed from the hole 3 in the grip rubber 2.

Figure 6:
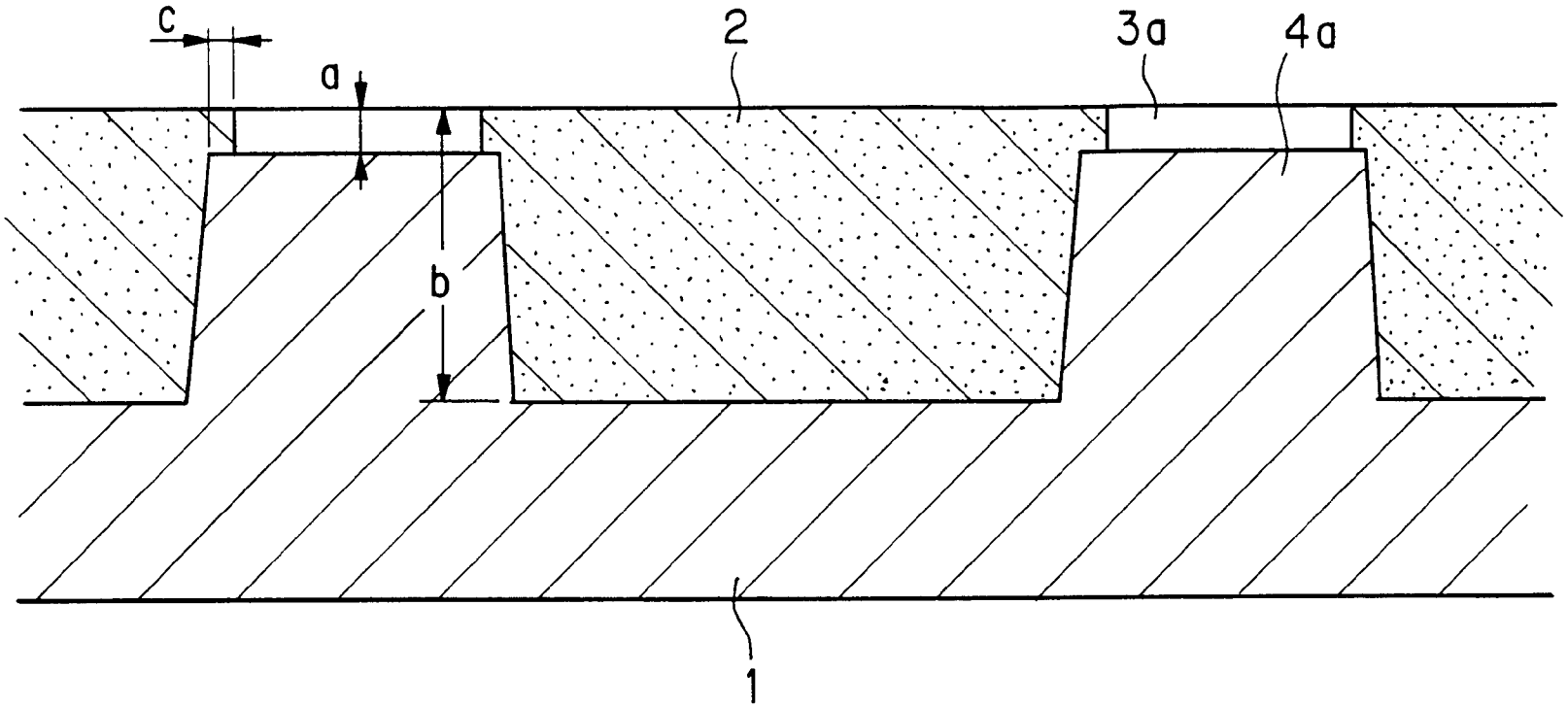
FIG. 6 is a sectional view along the line 14–15 in FIG. 5.

As shown in FIG. 6, a protrusion 4*a* that fits the hole 3*a* is provided in a position corresponding to the hole 3*a* in the grip rubber 2 in the barrel body 1. In addition, the surface of the protrusion 4*a* is made lower than that of the grip rubber 2 by 0.2 to 0.5 mm. That is to say, in FIG. 6, the size of a (unit: mm) is set to be in a range of $0.2 \leqq a < 0.5$. In addition, the outer diameter of the grip rubber 2 is set to be 12.4 mm. Furthermore , the size of b (unit: mm) in FIG. 6, that is, the depth of the hole 3*a* (same as the thickness of the grip rubber 2) is preferably in a range of $b \leqq 1.2$, and the size of c (unit: mm) is preferably in a range of $c \geqq 0.05$. As described above, by setting the surface of the protrusion 4*a* to be lower than the surface of the grip rubber 2 by 0.2 to 0.5 mm, the decorative pattern becomes three-dimensional to increase the effect of decoration. Moreover, when the pen is gripped with fingers, an effect of preventing slipping can be obtained, and an effect of preventing rotation of the grip rubber 2 can be also obtained by fitting the protrusion 4*a* in the hole 3*a*.

Figure 7:
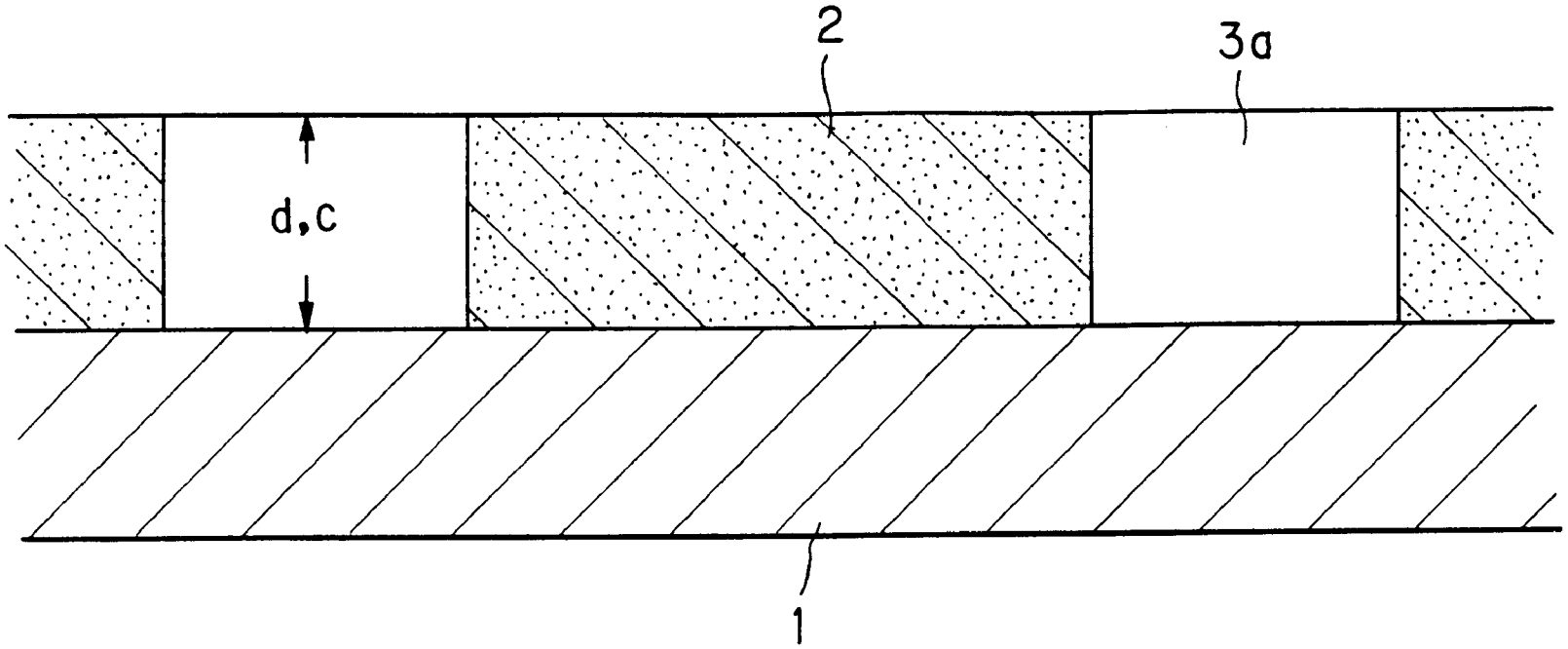
FIG. 7 is a sectional view at the same position as that of FIG. 6, in the case of having no protrusion in the barrel body.

In the second embodiment described above, the protrusion 4*a* to be fitted in the hole 3*a* in the grip rubber 2 is provided in the barrel body 1, but as shown in FIG. 7, even if the protrusion 4*a* is not provided on the surface of the barrel body 1 and the surface of the barrel body 1 is made flat, the same decorative effect can be obtained. In this case, the distanced from the surface of the grip rubber 2 to the surface of the barrel body 1 becomes equal to the depth e of the hole 3*a,* that is, d=e, however, the size of d or e (unit: mm) is preferably in a range of $0.5 \leqq d = e \leqq 1.2$.

As described above, in the second embodiment, by providing a hole having the same shape as a decorative pattern in the grip rubber attached to the outer periphery of the barrel body, the outer face of the barrel body having a different color from that of the grip rubber is exposed from the hole. Accordingly, since the decorative pattern appears in a different color from the color of the grip rubber in the grip rubber, the decorative pattern becomes conspicuous, and makes an appeal to consumers. Moreover, it is only required to provide a hole in the grip rubber, and the cost can be decreased compared to printing.

Furthermore, by providing a protrusion to be fitted in the hole in a position corresponding to the hole in the grip rubber in the barrel body, and lowering the surface of the protrusion than the surface of the grip rubber by 0.2 to 0.5 mm, increase of the decorative effect due to making the decorative pattern three-dimensional, an effect of preventing slipping when being gripped with fingers, and an effect of preventing rotation of the grip rubber can be expected simultaneously.

Figure 8:
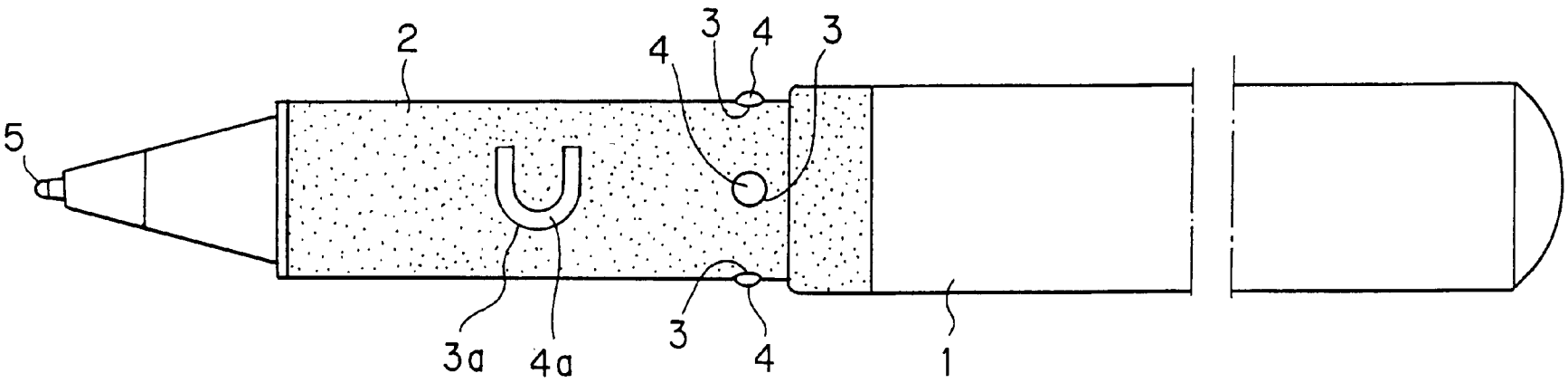
FIG. 8 is a side view in the combination of the first and second embodiments of the present invention.

It is a matter of course that the present invention is not limited to the first and second embodiments described above, and can be executed by optionally combining these embodiments as shown in FIG. 8.

In forming the rubber grip layer, the rubber grip layer such as the one in a cylindrical form or in a sheet form formed in advance, may be fitted in and attached to the barrel cylinder body, or it may be molded integrally with the barrel cylinder body, by a bi-color molding method or the like.

What is claimed is:

1. A writing instrument with a grip rubber, in which a hole is provided in a grip rubber layer formed in outer periphery of a barrel cylinder body, and a protrusion for catching a cap provided in the barrel cylinder body is protruded from the hole to outside of the grip rubber layer.

2. A writing instrument with a grip rubber according to claim 1, wherein said grip rubber layer is formed by being fitted into said barrel cylinder body.

3. A writing instrument with a grip rubber according to claim 1, wherein said grip rubber layer is formed integrally with the said barrel cylinder body by a bi-color molding.

4. A writing instrument with a grip rubber, in which a hole of the same shape as a decorative pattern is provided in the grip rubber layer formed in outer periphery of a barrel body, thereby outer face of the barrel cylinder body having a different color from that of the grip rubber is exposed from the hole, as well as a protrusion to be fitted into the hole is provided in a position corresponding to the hole for decoration in the grip rubber layer, such that surface of the protrusion becomes lower than surface of the grip rubber by 0.2 to 0.5 mm.

5. A writing instrument with a grip rubber, in which a hole is provided in the grip rubber layer formed in outer periphery of a barrel cylinder body, and a protrusion for catching a cap provided in the barrel cylinder body is protruded from the hole to outside of the grip rubber layer, and further, a hole of the same shape as a decorative pattern is provided in the grip rubber layer formed in the outer periphery of the barrel cylinder body, thereby the outer face of the barrel body having a different color from that of the grip rubber is exposed from the hole.

6. A writing instrument with a grip rubber, in which a hole is provided in the grip rubber layer formed in outer periphery of the barrel cylinder body, a protrusion for catching a cap provided in the barrel cylinder body is protruded from the hole to outside of the grip rubber layer, and a hole of the same shape as a decorative pattern is provided in the grip rubber layer formed in the outer periphery of the barrel body, thereby outer face of the barrel cylinder body having a different color from that of the grip rubber is exposed from the hole, as well as a protrusion to be fitted into the hole is provided in a position corresponding to the hole for decoration in the grip rubber layer, such that surface of the protrusion becomes lower than surface of the grip rubber by 0.2 to 0.5 mm.

* * * * *